US010760865B2

(12) United States Patent
Fischer

(10) Patent No.: US 10,760,865 B2
(45) **Date of Patent: *Sep. 1, 2020**

(54) MAGAZINE LOADER

(71) Applicant: VISTA OUTDOOR OPERATIONS LLC, Anoka, MN (US)

(72) Inventor: Paul R. Fischer, Olathe, KS (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/529,376

(22) Filed: Aug. 1, 2019

(65) Prior Publication Data

US 2020/0124367 A1 Apr. 23, 2020

Related U.S. Application Data

(63) Continuation of application No. 16/270,951, filed on Feb. 8, 2019, now Pat. No. 10,422,599, which is a continuation of application No. 16/036,321, filed on Jul. 16, 2018, now Pat. No. 10,240,879, which is a (Continued)

(51) Int. Cl.
*F41A 9/83* (2006.01)
*F41A 9/72* (2006.01)

(52) U.S. Cl.
CPC . *F41A 9/83* (2013.01); *F41A 9/72* (2013.01)

(58) Field of Classification Search
CPC ..... F41A 9/83; F41A 9/72
See application file for complete search history.

(56) References Cited

U.S. PATENT DOCUMENTS 3,628,273 A * 12/1971 Lach ..... F41A 9/83 42/87
4,392,321 A * 7/1983 Bosworth ..... F41A 9/83 42/87
4,736,667 A 4/1988 Kochevar et al.
(Continued)

FOREIGN PATENT DOCUMENTS

CN 105637317 A 6/2016

OTHER PUBLICATIONS

IPO Search Report dated May 19, 2020 in Taiwanese counterpart application TW 108123438.

*Primary Examiner* — J. Woodrow Eldred
(74) *Attorney, Agent, or Firm* — Gerard M. Donovan; Walter M. Egbert; Reed Smith LLP

(57) ABSTRACT

A magazine loader for loading a batch of rimmed cartridges into a tubular rifle magazine is disclosed. In embodiments, the magazine loader comprises an elongate body comprising a hopper portion and a tubular magazine receiving portion with a circular aperture for receiving the tubular rifle magazine. In embodiments, the body defines a feed passageway extending between the hopper portion and the circular aperture of the tubular magazine receiving portion. The body may define, extending along the feed passageway, a first cartridge orienting passageway defined by a first cartridge orienting portion, a second cartridge orienting passageway defined by a second cartridge orienting portion, a third cartridge orienting passageway defined by a third cartridge orienting portion, and a fourth cartridge orienting passageway defined by a fourth cartridge orienting portion.

20 Claims, 16 Drawing Sheets

Related U.S. Application Data continuation-in-part of application No. 29/575,016, filed on Aug. 22, 2016, now Pat. No. Des. 823,420.

(56) References Cited

U.S. PATENT DOCUMENTS

| | | | | |
|---|---|---|---|---|
| 4,970,820 | A * | 11/1990 | Miller | F41A 9/83 42/87 |
| 2003/0046854 | A1 | 3/2003 | Urchek | |
| 2014/0033592 | A1* | 2/2014 | Fiorucci | F41A 9/83 42/87 |
| 2017/0176121 | A1 | 6/2017 | Plate | |

* cited by examiner

MAGAZINE LOADER

CROSS-REFERENCE TO RELATED APPLICATIONS

This application is a continuation of U.S. patent application Ser. No. 16/270,951 filed on Feb. 8, 2019, which is a continuation of U.S. patent application Ser. No. 16/036,321 filed on Jul. 16, 2018, which is a continuation-in-part of U.S. patent application Ser. No. 29/575,016, filed Aug. 22, 2016, the disclosures of which are incorporated by reference herein.

BACKGROUND OF THE DISCLOSURE

In order to maintain their proficiency with various types of firearms, military personnel, law enforcement officers and hunters frequently engage in target practice. In the sport of hunting, marksmanship is practiced so that a shot can be carefully placed to ensure a quick, clean and humane kill. For military personnel, good marksmanship may make the difference between victory and defeat in battlefield situations. Target practice is often performed at a shooting range with 300 or more cartridges being fired at each practice session. The expense involved in firing 300 rounds can be mitigated by using a firearm that fires 22 caliber long rifle rimfire ammunition. The design of this ammunition allows it to be manufactured at relatively low cost and millions of 22 caliber rifles have been manufactured to use this ammunition. A number of popular 22 caliber rifles utilize a tubular magazine extending below the rifle barrel. A magazine loader suitable for use with tubular magazines for 22 caliber rifles would be welcomed by the marketplace.

SUMMARY

A magazine loader for loading a batch of rimmed cartridges into a tubular rifle magazine is disclosed. In embodiments, the magazine loader comprises an elongate body comprising a hopper portion and a tubular magazine receiving portion with a circular aperture for receiving the tubular rifle magazine. In embodiments, the body defines a feed passageway extending between the hopper portion and the circular aperture of the tubular magazine receiving portion. The body may include, extending along the feed passageway, a first cartridge orienting portion, a second cartridge orienting portion, a third cartridge orienting portion, and a fourth cartridge orienting portion. The body may define, extending along the feed passageway, a first cartridge orienting passageway defined by the first cartridge orienting portion, a second cartridge orienting passageway defined by the second cartridge orienting portion, a third cartridge orienting passageway defined by the third cartridge orienting portion, and a fourth cartridge orienting passageway defined by the fourth cartridge orienting portion.

In embodiments, the magazine loader may comprise a closeable hopper cover at the top of the hopper portion, an adjustable cartridge quantity selector at a bottom of the hopper portion, and a movable gate positioned in the body between the second cartridge orienting portion and the third cartridge orienting portion. In embodiments, the magazine loader is manually holdable, tippable and shakable, and has a magazine loading position with the magazine loader being positioned horizontal or tipped slightly at an acute angle from horizontal, a channel loading and cartridge orienting mode where the magazine loader is shaken with the magazine loader at an inclined angle, and a magazine loading mode where the loader is mostly upright or at an acute angle from vertical and a portion of the tubular magazine is inserted in the tubular magazine receiving portion.

In embodiments, the hopper portion defines a hopper cavity sized to receive an unordered batch of cartridges. In embodiments, the hopper cavity opens into a three-sided channel of the feed passageway defined by two channel wall portions and a channel floor. In embodiments, the body has a pair of opposing shoulders extending along an upward portion of the three-sided channel for keeping rimmed ends of the cartridges upward in the three-sided channel. At the three-sided channel, the body may define the first cartridge orienting portion. In embodiments, the three-sided channel has a first height, wherein when a plurality of unordered cartridges enter the three-sided channel the cartridges are guided toward a tip first orientation and aligned side-by-side in a side-by-side ordered upright first row in the three-sided channel. In embodiments, the number of cartridges disposed in the three-sided channel can be selected using the adjustable cartridge quantity selector.

In embodiments, the three-sided channel extends into a second cartridge orienting passageway at the second cartridge orienting portion of the body where two opposing passageway wall portions, a floor portion, and a ceiling portion. In embodiments, the second cartridge orienting passageway has a second height that is less than the first height of the three-sided channel. In embodiment, the pair of opposing shoulders extend into the second cartridge orienting passageway, whereby the plurality of cartridges in the side-by-side ordered upright first row enter the second cartridge orienting passageway, each cartridge tipping forward to a rimmed ends forward and inclined side-by-side row.

In embodiments, the second cartridge orienting passageway extends into the third cartridge orienting passageway defined by the third cartridge orienting portion of the body. In embodiments, the third cartridge orienting portion of the body defines a third cartridge orienting passageway having a converging ceiling and floor. In embodiments, the third cartridge orienting portion of the body defines a third cartridge orienting passageway that converges to a third passageway. In embodiments, the third passageway is less than the second height. In embodiments, the third cartridge orienting portion of the body defines a third cartridge orienting passageway adapted and dimensioned so that the plurality of cartridges in the rimmed ends forward and inclined side-by-side row are, by force of gravity, rotated to form a rimmed end to tip end row. In embodiments, the third cartridge orienting passageway extends to a fourth cartridge orienting passageway defined by the fourth cartridge orienting portion of the body. In embodiments, the fourth cartridge orienting portion of the body defines a fourth cartridge orienting passageway adapted and dimensioned so that gravity feeds, orients, and/or directs a plurality of cartridges into alignment with the tubular rifle magazine for loading cartridges into the tubular rifle magazine.

In embodiments, the magazine loader comprises a spring having a first end seated against the moveable gate member and a second end seated against the body. The spring may apply a spring bias force to the moveable gate member. The spring bias force may bias the moveable gate toward a closed position. In embodiments, the moveable gate member comprises a T-shaped part. In embodiments, the T-shaped part has a downward extending leg and two finger engaging tabs. In embodiments, a first finger engaging tab extends away from the downward extending leg in a first direction, the second finger engaging tab extends away from the downward extending leg in a second direction, and the second direction being opposite the first direction. In embodiments, the body of the magazine loader comprises a first clamshell portion and a second clamshell portion. In embodiments, the first finger engaging tab of the moveable gate member extends through the first clamshell portion and the second finger engaging tab of the moveable gate member extends through the second clamshell portion.

In embodiments, the magazine loader comprises an adjustable cartridge quantity selector that is slidingly supported by the body and positioned at the bottom of the hopper cavity. In embodiments, the adjustable cartridge quantity selector is positioned to selectively or continuously cover a covered portion of the upper opening of the three-sided channel. The length of the covered portion may be varied as the adjustable cartridge quantity selector slides relative to the body. In embodiments, the hopper cavity defined by the hopper portion is sized to receive an unordered batch of cartridges and the hopper cavity opens into a three-sided channel located at the bottom thereof. In embodiments the bottom the hopper portion is funnel-like so that upon shaking of the hopper portion, a plurality of unordered cartridges enter the three-sided channel, the cartridges being guided toward a tip first orientation and aligned side-by-side in a first row in the three-sided channel. In embodiments, a first group of the cartridges aligned side-by-side in the first row in the three-sided channel are disposed under the adjustable cartridge quantity selector and a second group of the cartridges aligned side-by-side in the first row in the three-sided channel are not disposed under the adjustable cartridge quantity selector. The magazine loader may be tipped toward a vertical orientation, so that the cartridges in the second group not disposed under the adjustable cartridge quantity selector fall out of the three-sided channel and into the hopper cavity. The number of cartridges remaining in the three-sided channel may be determined by the position of the adjustable cartridge quantity selector when the magazine loader is tipped toward the vertical orientation. In embodiments, the adjustable cartridge quantity selector comprises a pointer and the body includes quantity indicating indicia. In embodiments, the quantity indicating indicia are positioned such that the pointer of the adjustable cartridge quantity selector points to one of the quantity indicating indicia corresponding to the number of cartridges remaining in the three-sided channel after the magazine loader is tipped toward the vertical orientation. Once a selected quantity of cartridges have been placed in the three-sided channel, the selected quantity of cartridges can be loaded into a tubular rifle magazine.

In embodiments, a method for loading a batch of rimmed cartridges into a tubular rifle magazine may comprise providing a magazine loader including an adjustable cartridge quantity selector that is slidingly supported by a body and positioned at the bottom of a hopper cavity defined by the body. In embodiments, the adjustable cartridge quantity selector is positioned to selectively or continuously cover a covered portion of an upper opening of a three-sided channel that opens into the hopper cavity. The length of the covered portion may be varied as the adjustable cartridge quantity selector slides relative to the body. In embodiments the bottom the hopper portion is funnel-like so that upon shaking of the hopper portion, a plurality of unordered cartridges enter the three-sided channel, the cartridges being guided toward a tip first orientation and aligned side-by-side in a first row in the three-sided channel. In embodiments, a first group of the cartridges aligned side-by-side in the first row in the three-sided channel are disposed under the adjustable cartridge quantity selector and a second group of the cartridges aligned side-by-side in the first row in the three-sided channel are not disposed under the adjustable cartridge quantity selector. The magazine loader may be tipped away from a vertical orientation, so that the cartridges in the second group not disposed under the adjustable cartridge quantity selector fall out of the three-sided channel and into the hopper cavity. The number of cartridges remaining in the three-sided channel may be determined by the position of the adjustable cartridge quantity selector when the magazine loader is tipped away from the vertical orientation. In embodiments, the adjustable cartridge quantity selector comprises a pointer and the body includes quantity indicating indicia. In embodiments, the quantity indicating indicia are positioned such that the pointer of the adjustable cartridge quantity selector points to one of the quantity indicating indicia corresponding to the number of cartridges remaining in the three-sided channel after the magazine loader is tipped toward the vertical orientation. Once a selected quantity of cartridges have been placed in the three-sided channel, the selected quantity of cartridges can be loaded into a tubular rifle magazine.

A feature and advantage of embodiments is a magazine loader including an adjustable cartridge quantity selector. The number of cartridges to be loaded in a tubular magazine can be selected using the adjustable cartridge quantity selector.

A feature and advantage of embodiments is a magazine loader including a moveable gate with left and right finger engaging tabs. The gate can be selectively opened to begin loading cartridges into a tubular magazine.

A feature and advantage of embodiments is a magazine loader that mates with tubular rifle magazines. A feature and advantage of embodiments involves providing a magazine loader that is capable of receiving tubular magazines from firearms of various makes and models without requiring a user to make adjustments to the magazine loader. A cavity of the magazine loader has sufficient clearance around each tubular magazine to provide a multi-magazine fit. For example, a user can load magazines from multiple firearms of different makes and/or models during a visit to a firing range.

A feature and advantage of embodiments is a magazine loader including a gravity operated mechanism that feeds and orients cartridges from unordered batch into a row of cartridges arranged in end-to-end alignment.

A magazine loader for loading rimmed cartridges into a tubular rifle magazine of a rifle is provided. In embodiments, the magazine loader comprises a body comprising a hopper portion, a magazine receiving portion, a first cartridge orienting portion, a second cartridge orienting portion, a third cartridge orienting portion, and a fourth cartridge orienting portion. In embodiments, the magazine receiving portion defines a cylindrically shaped magazine receiving bore extending along a magazine insertion and withdrawal axis. In embodiments, the magazine insertion and withdrawal axis extends in a rearward direction and a forward direction relative to the body. The body may be rotated between a horizontal position and a vertical position, the insertion and withdrawal axis extending horizontally and the hopper portion being above the first cartridge orienting portion while the body is in the horizontal position and the hopper portion being above the magazine receiving portion and the insertion and withdrawal axis extending somewhat vertically while the body is in the vertical position.

In embodiments, the hopper portion defines a hopper cavity sized to receive an unordered batch of cartridges. In embodiments, the hopper cavity opens into a first channel defined by the first cartridge orienting portion. In embodiments, the hopper portion defines a hopper cavity sized to receive an unordered batch of cartridges. In embodiments, the hopper portion has a V-shape so that upon agitation of the hopper portion, a plurality of the unordered cartridges enter the first cartridge orienting portion in a tip first orientation and become sequentially aligned in a row along the first cartridge orienting portion.

In embodiments, the first cartridge orienting portion comprises two opposing channel wall portions, the first channel wall portions defining a first channel that opens into the hopper cavity. In embodiments, the first channel has a width selected such that a projectile portion of each cartridge passes into the first channel, but a rim portion of each cartridge does not pass into the first channel. When this is the case, each cartridge may hang vertically by its rim when the body is assuming the horizontal orientation.

In embodiments, the second cartridge orienting portion comprises two opposing channel wall portions, the channel wall portions defining a second channel that opens into the first channel defined by the first cartridge orienting portion. In embodiments, each cartridge falls, by force of gravity, into the second channel from the first channel when the body is rotated to the vertical orientation. In embodiments, the second channel has a depth selected such that the projectile portion of each cartridge contacts a second cartridge orienting surface when the body is rotated to the vertical orientation. In embodiments, each cartridge falls, by force of gravity, into the second channel from the first channel, and each cartridge rotates to a skewed orientation as the projectile portion of each cartridge contacts the second cartridge orienting surface.

In embodiments, the third cartridge orienting portion is dimensioned and configured such that that, as each cartridge falls out of the second channel, by force of gravity, the rim of each cartridge contacts a rim engaging and orienting surface of the third cartridge orienting portion. In embodiments, the fourth cartridge orienting portion includes a fourth orienting surface, the fourth orienting surface being oriented such that, when a cartridge contacts the fourth orienting surface, the cartridge rotates to an orientation in which a longitudinal axis of the cartridge is parallel to the insertion and withdrawal axis whereby each cartridge falls, by force of gravity, in a rim first orientation downward through the magazine receiving bore.

The above summary is not intended to describe each illustrated embodiment or every implementation of the present disclosure.

BRIEF DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
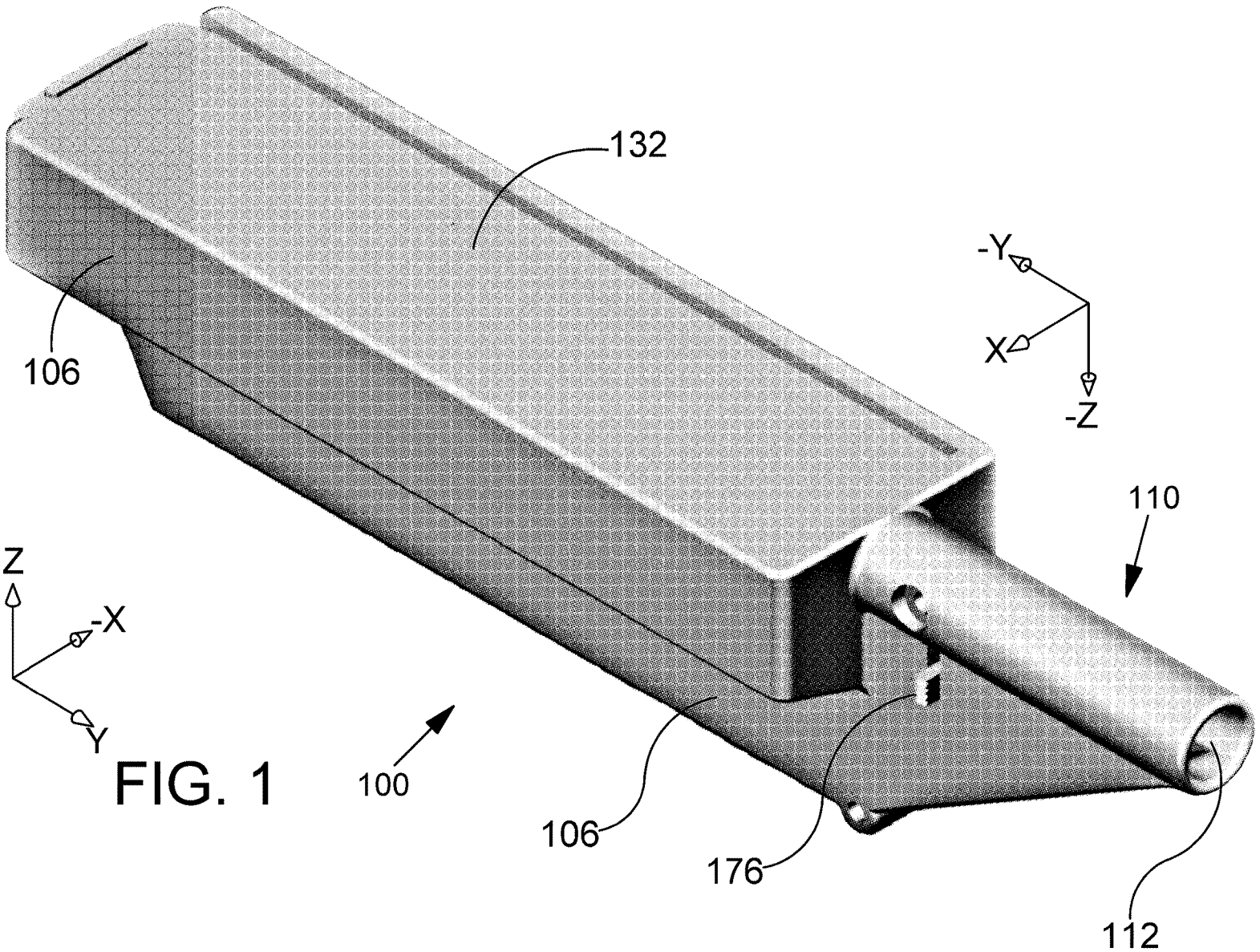
FIG. 1 is a perspective view of a magazine loader in accordance with the detailed description.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIGS. 1-3B, a magazine loader 100 for loading a batch of rimmed cartridges 102 into a tubular rifle magazine 104 is disclosed. In embodiments, the magazine loader 100 comprises an elongate body 106 comprising a hopper portion 108 and a tubular magazine receiving portion 110 with a circular aperture 112 for receiving the tubular rifle magazine 104. In embodiments, the body 106 defines a feed passageway 114 extending between the hopper portion 108 and the circular aperture 112 of the tubular magazine receiving portion 110. The body 106 may include, extending along the feed passageway 114, a first cartridge orienting portion 116, a second cartridge orienting portion 118, a third cartridge orienting portion 120, and a fourth cartridge orienting portion 122. The body 106 may define, extending along the feed passageway 114, a first cartridge orienting passageway 124 defined by the first cartridge orienting portion 116, a second cartridge orienting passageway 126 defined by the second cartridge orienting portion 118, a third cartridge orienting passageway 128 defined by the third cartridge orienting portion 120, and a fourth cartridge orienting passageway 130 defined by the fourth cartridge orienting portion 122.

Referring to FIGS. 1-3B and 9, the magazine loader 100 may comprise a closeable hopper cover 132 at the top of the hopper portion 108, an adjustable cartridge quantity selector 134 at a bottom of the hopper portion 108, and a movable gate 136 positioned in the body 106 between the second cartridge orienting portion 118 and the third cartridge orienting portion 120. In embodiments, the magazine loader 100 is manually holdable, tippable and shakable, and has a magazine loading position with the magazine loader 100 being positioned horizontal or tipped slightly at an acute angle from horizontal, a channel loading and cartridge orienting mode where the magazine loader is shaken with the magazine loader at an inclined angle, and a magazine loading mode where the loader is mostly upright or at an acute angle from vertical and a portion of the tubular magazine is inserted in the tubular magazine receiving portion.

Figure 2:
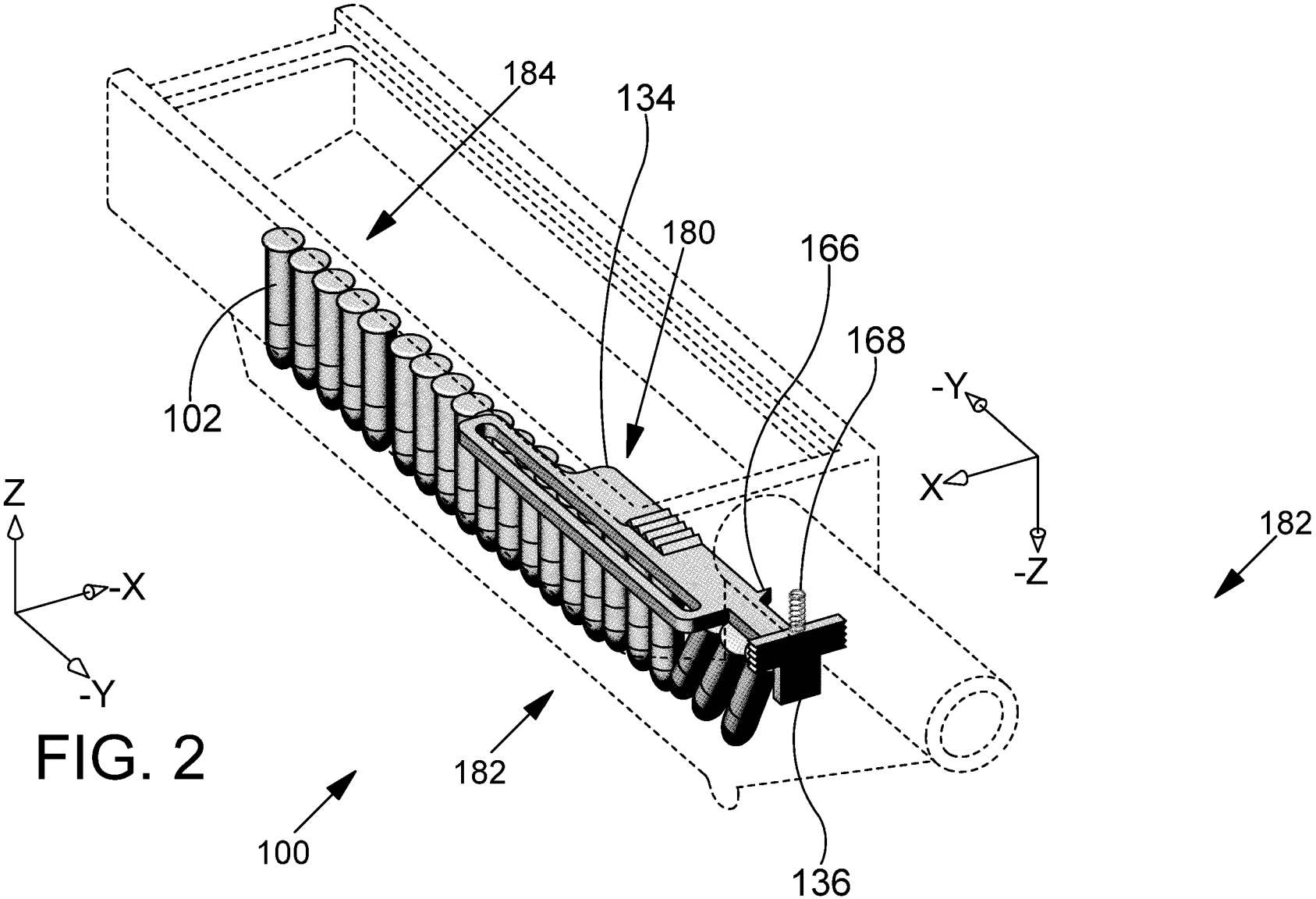
FIG. 2 is a stylized perspective view of a magazine loader in accordance with the detailed description.
Figure 3B:
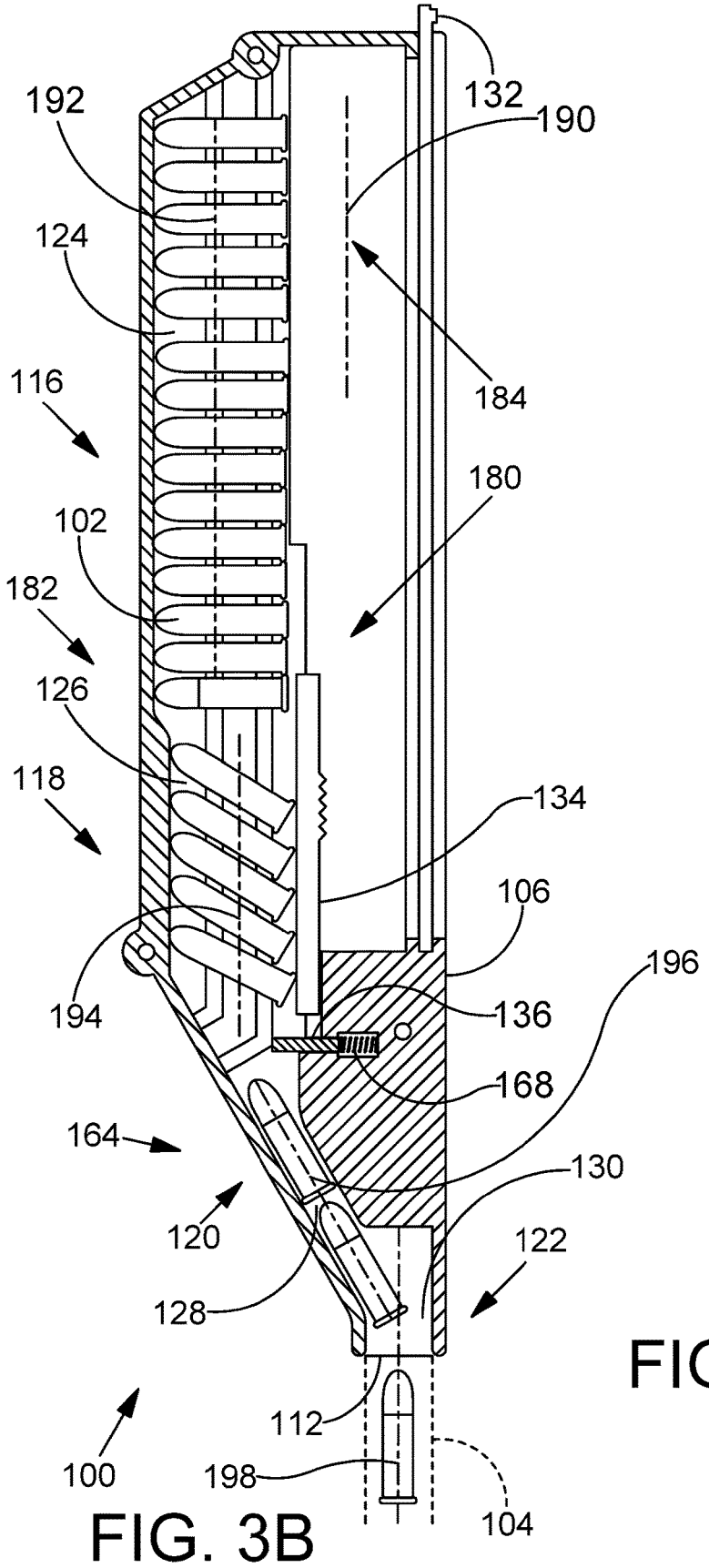
FIG. 3B is a cross-sectional view of a magazine loader in accordance with the detailed description.
Figure 3A:
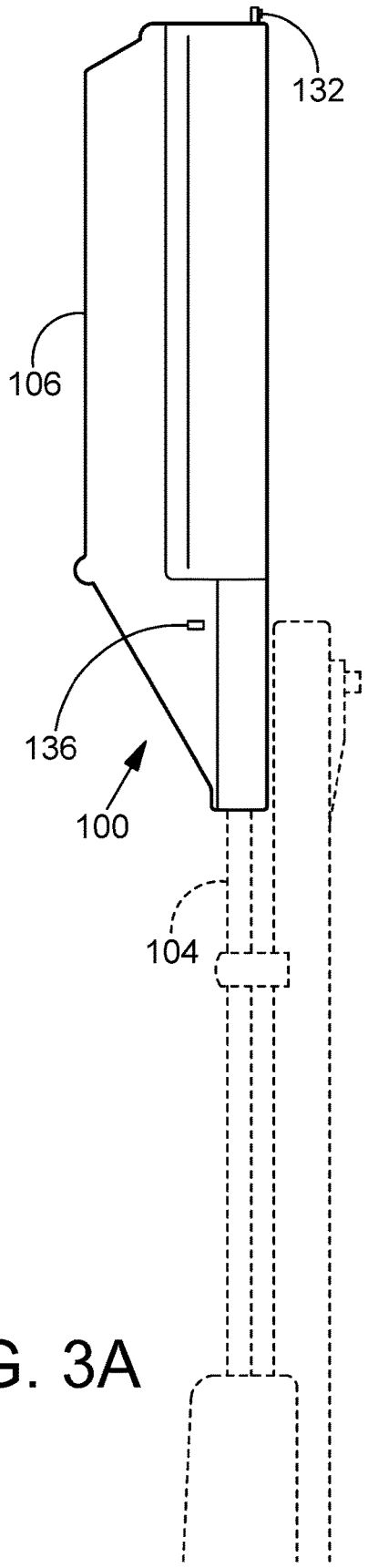
FIG. 3A is an elevation view of a rifle and a magazine loader in accordance with the detailed description.

Referring to FIGS. 2 and 3A, in embodiments, the hopper portion 108 defines a hopper cavity 138 sized to receive an unordered batch of cartridges 102. In embodiments, the hopper cavity 138 opens into a three-sided channel 140 of the feed passageway 114 defined by two channel wall portions 142 and a channel floor 144. In embodiments, the body 106 has a pair of opposing shoulders 146 extending along an upward portion of the three-sided channel 140 for keeping rimmed ends of the cartridges 102 upward in the three-sided channel 140. At the three-sided channel 140, the body 106 may define the first cartridge orienting portion 116. In embodiments, the three-sided channel 140 has a first height 148, wherein when a plurality of unordered cartridges 102 enter the three-sided channel 140 the cartridges 102 are guided toward a tip first orientation and aligned side-by-side in a side-by-side ordered upright first row 158 in the three-sided channel 140. In embodiments, the number of cartridges 102 disposed in the three-sided channel 140 can be selected using the adjustable cartridge quantity selector 134.

Figure 4A:
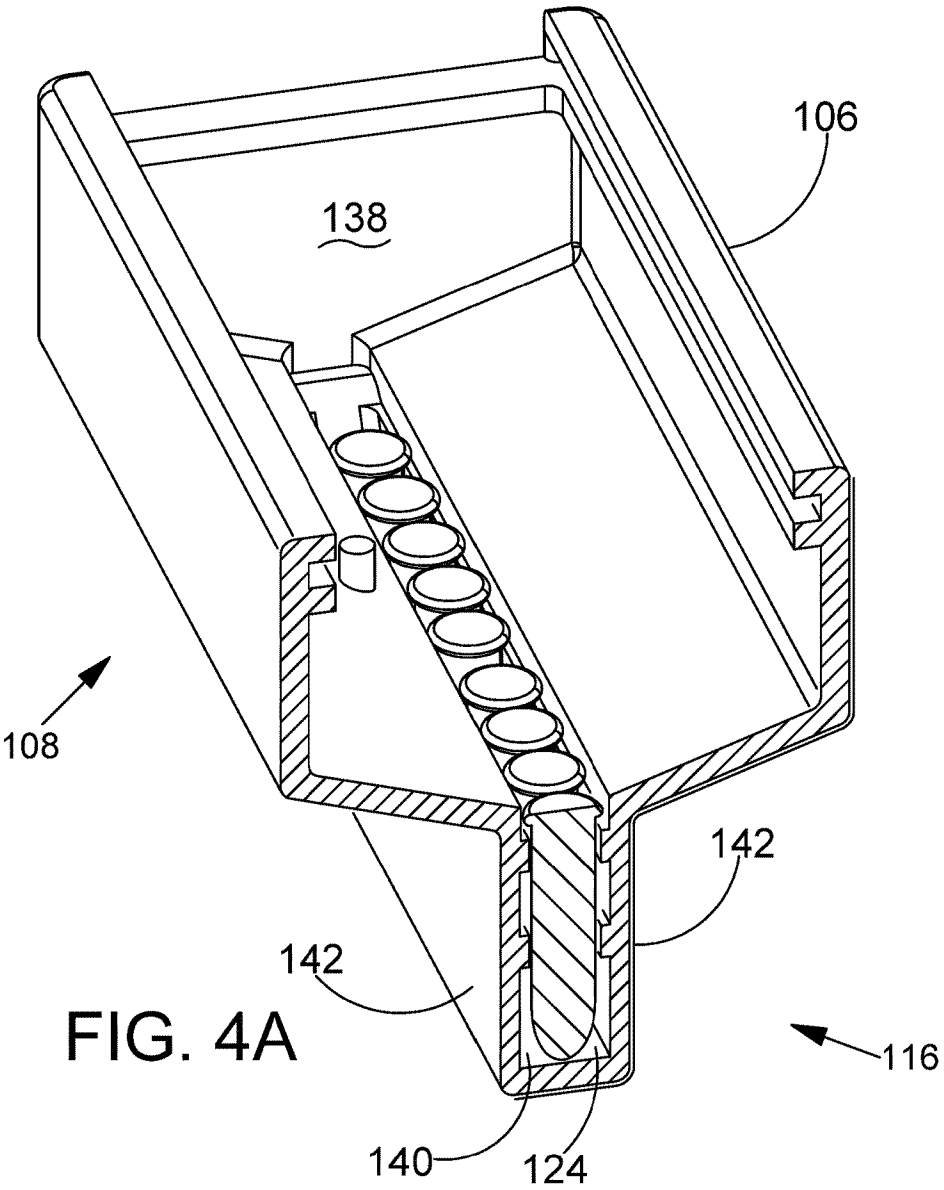
FIG. 4A is a cross-sectional view of a magazine loader in accordance with the detailed description.
Figure 4B:
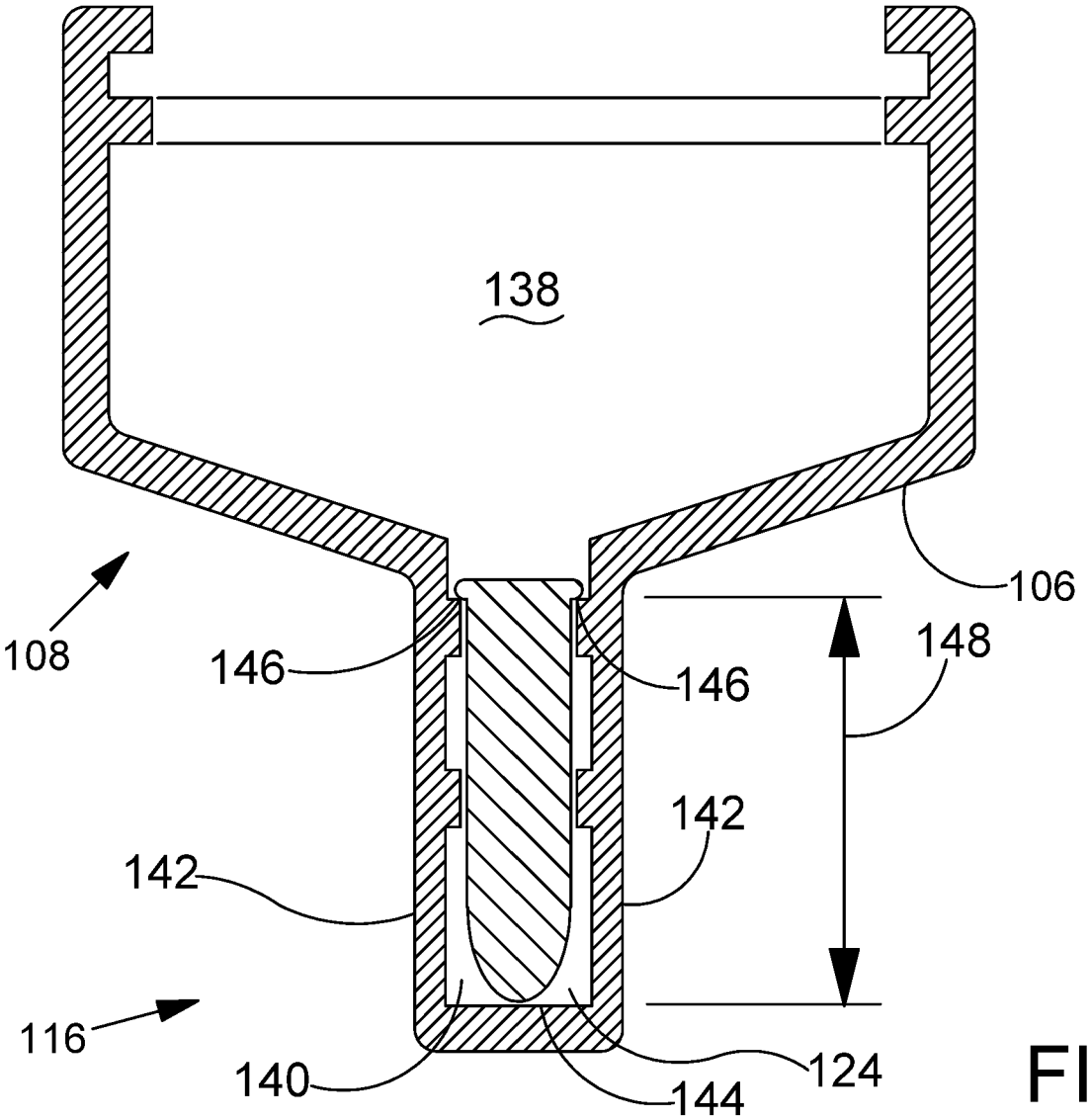
FIG. 4B is a cross-sectional view of a magazine loader in accordance with the detailed description.

Referring to FIGS. 3 and 4, in embodiments, the three-sided channel 140 extends into a second cartridge orienting passageway 126 at the second cartridge orienting portion 118 of the body 106 where two opposing passageway wall portions 150, a floor portion 152, and a ceiling portion 154. In embodiments, the second cartridge orienting passageway 126 has a second height 156 that is less than the first height 148 of the three-sided channel 140. In embodiment, the pair of opposing shoulders 146 extend into the second cartridge orienting passageway 126, whereby the plurality of cartridges in the side-by-side ordered upright first row 158 enter the second cartridge orienting passageway 126, each cartridge tipping forward to a rimmed ends forward and inclined side-by-side row 160.

Referring to FIGS. 1-4, in embodiments, the second cartridge orienting passageway 126 extends into the third cartridge orienting passageway 128 defined by the third cartridge orienting portion 120 of the body 106. In embodiments, the third cartridge orienting portion 120 of the body 106 defines a third cartridge orienting passageway 128 having a converging ceiling and floor. In embodiments, the third cartridge orienting portion 120 of the body 106 defines a third cartridge orienting passageway 128 that converges to a third passageway 162. In embodiments, the third passageway 162 is less than the second height 156. In embodiments, the third cartridge orienting portion 120 of the body 106 defines a third cartridge orienting passageway 128 adapted and dimensioned so that the plurality of cartridges in the rimmed ends forward and inclined side-by-side row 160 are, by force of gravity, rotated to form a rimmed end to tip end row 164. In embodiments, the third cartridge orienting passageway 128 extends to a fourth cartridge orienting passageway 130 defined by the fourth cartridge orienting portion 122 of the body 106. In embodiments, the fourth cartridge orienting portion 122 of the body 106 defines a fourth cartridge orienting passageway 130 adapted and dimensioned so that gravity feeds, orients, and/or directs a plurality of cartridges into alignment with the tubular rifle magazine 104 for loading cartridges 102 into the tubular rifle magazine 104.

Figure 5:
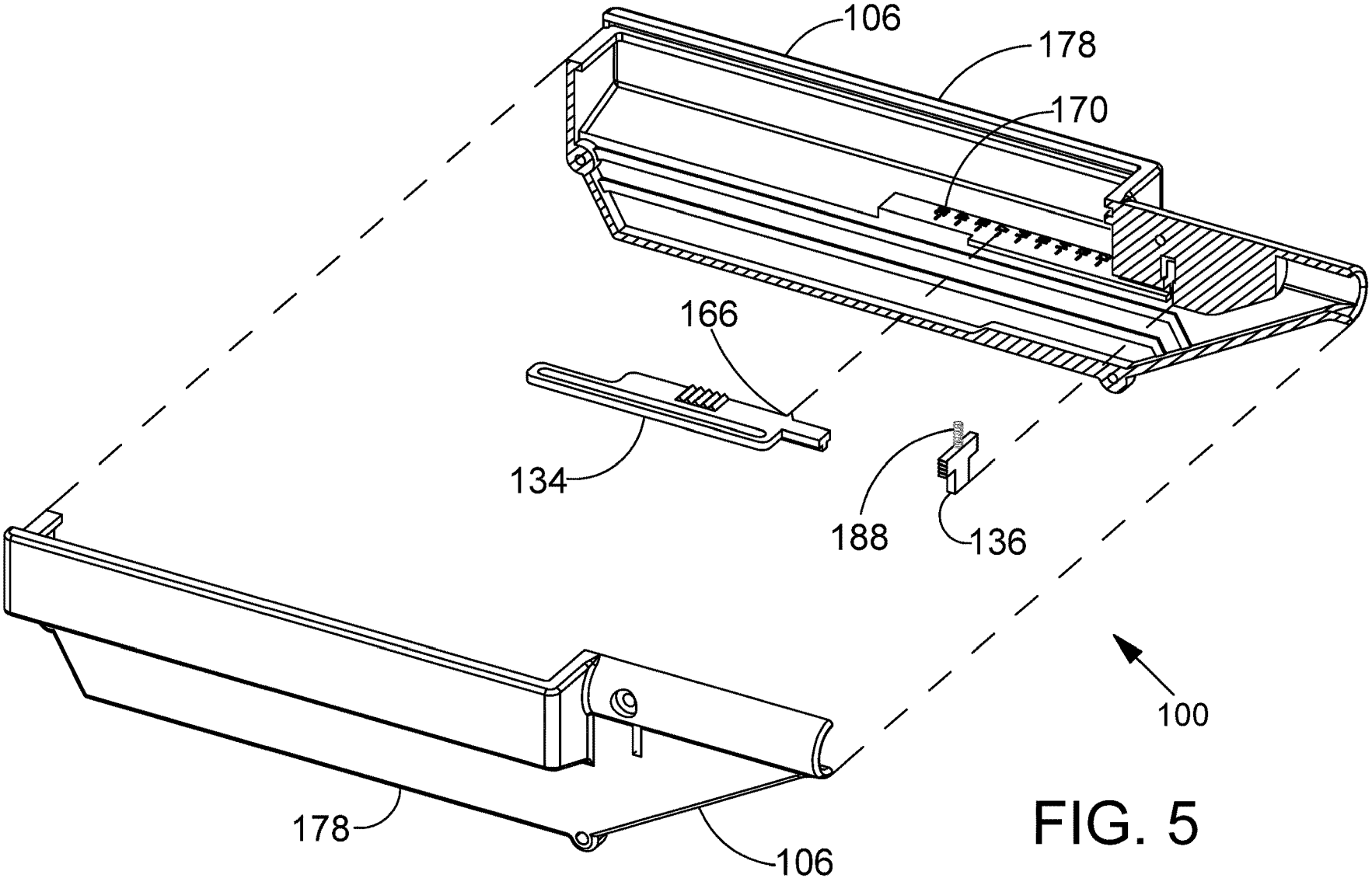
FIG. 5 is an exploded view of a magazine loader in accordance with the detailed description.
Figure 6:
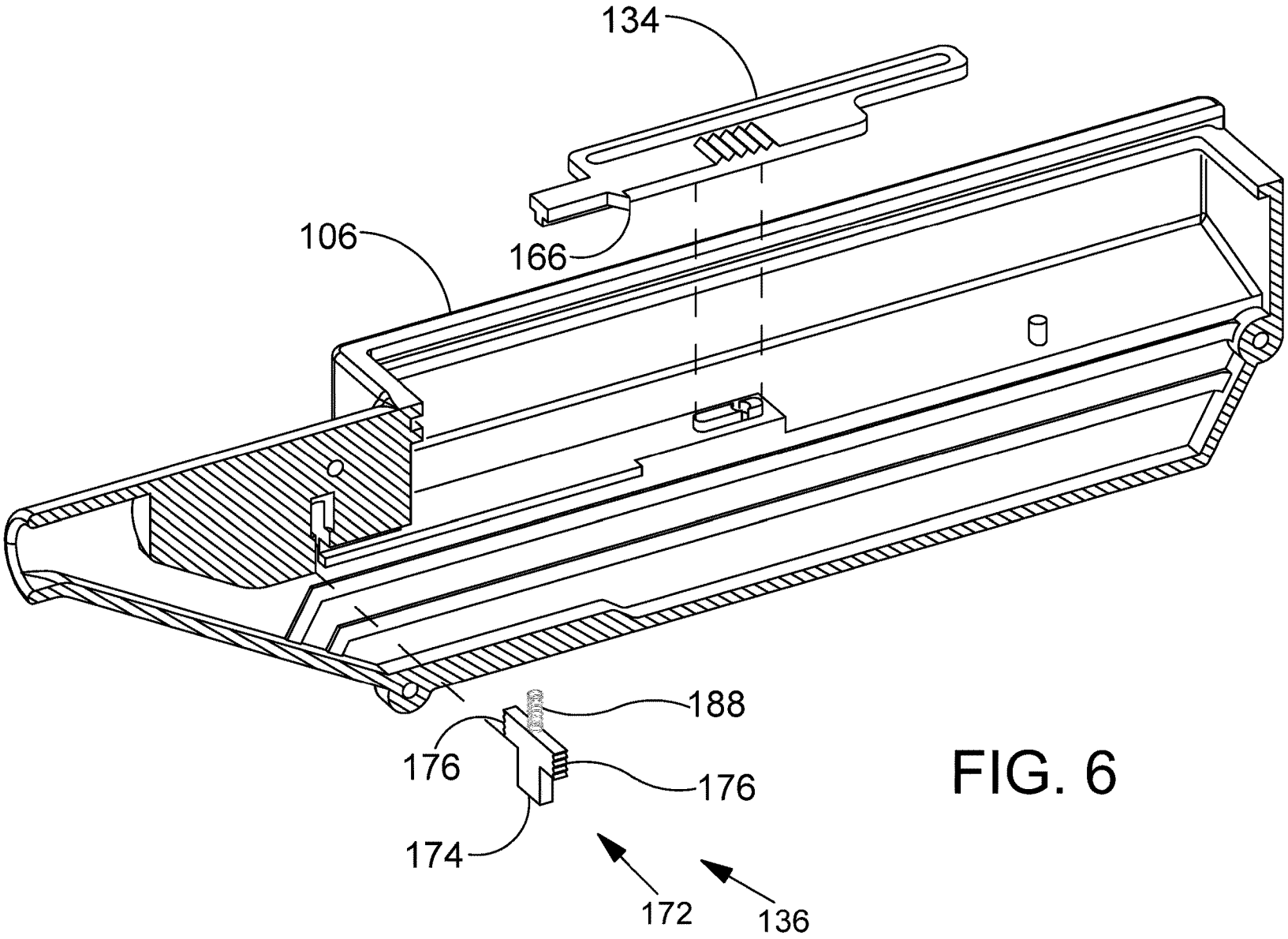
FIG. 6 is a perspective view showing a portion of a magazine loader in accordance with the detailed description.
Figure 7:
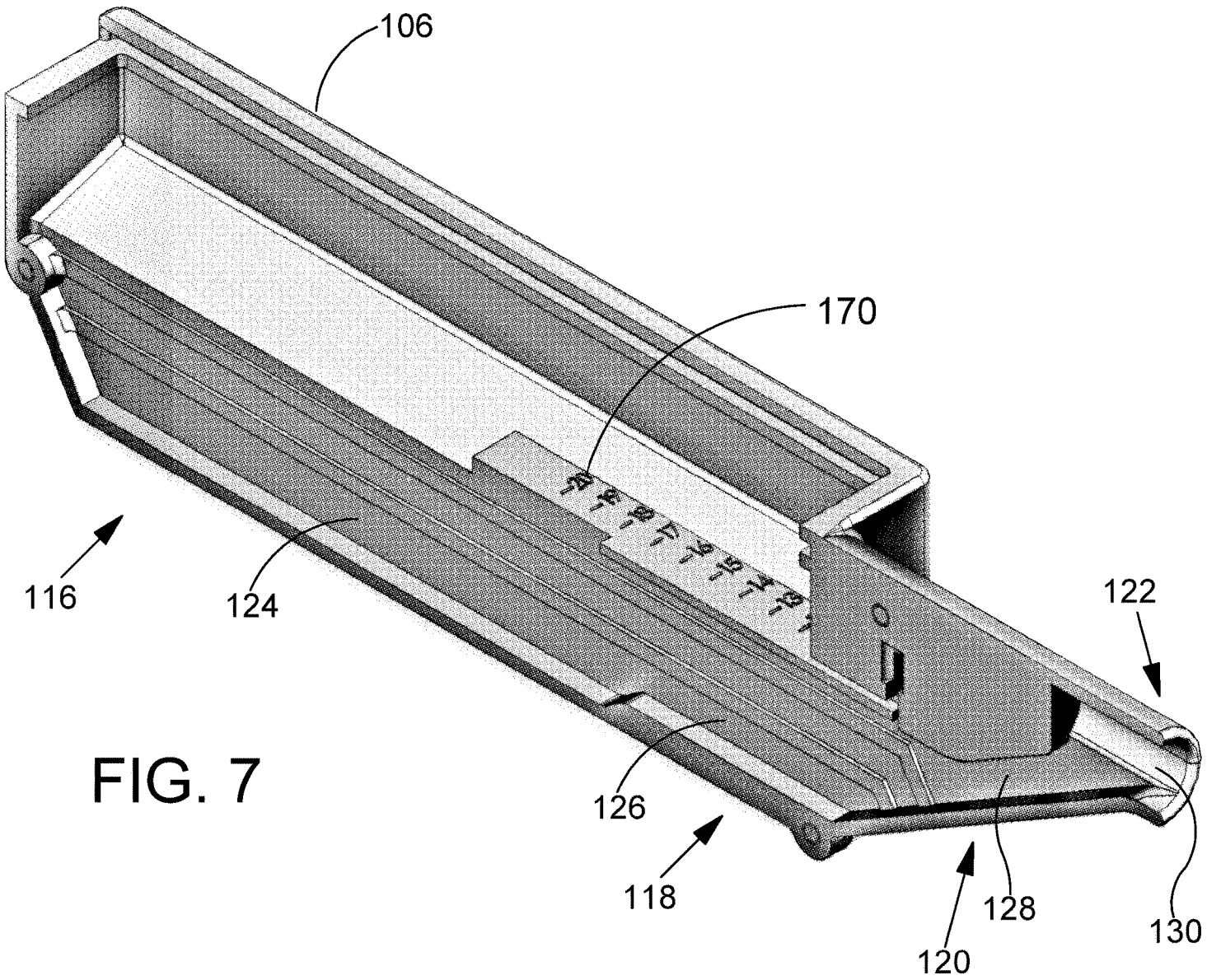
FIG. 7 is a perspective view showing a portion of a magazine loader in accordance with the detailed description.
Figure 8:
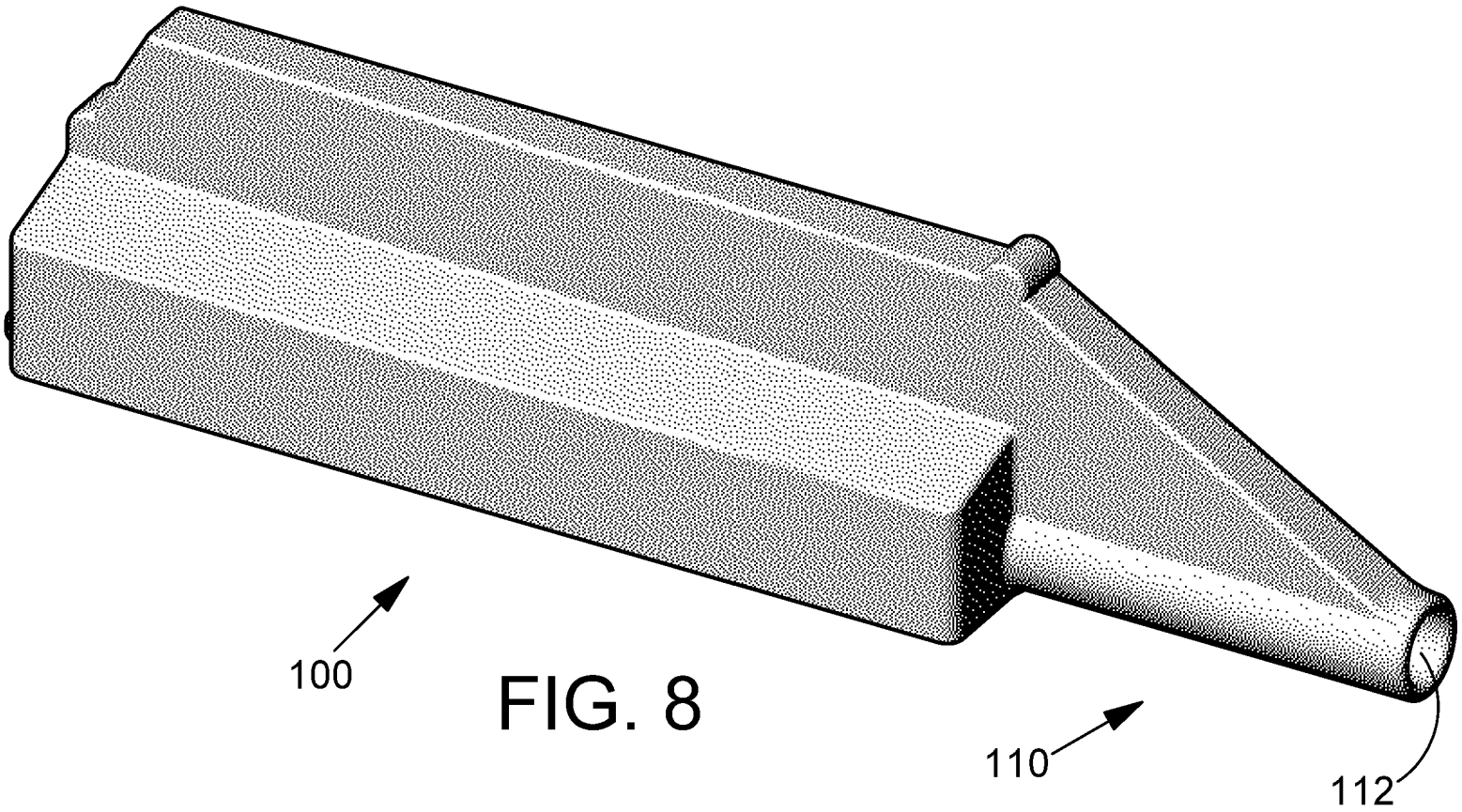
FIG. 8 is a perspective view of a magazine loader in accordance with the detailed description.
Figure 9:
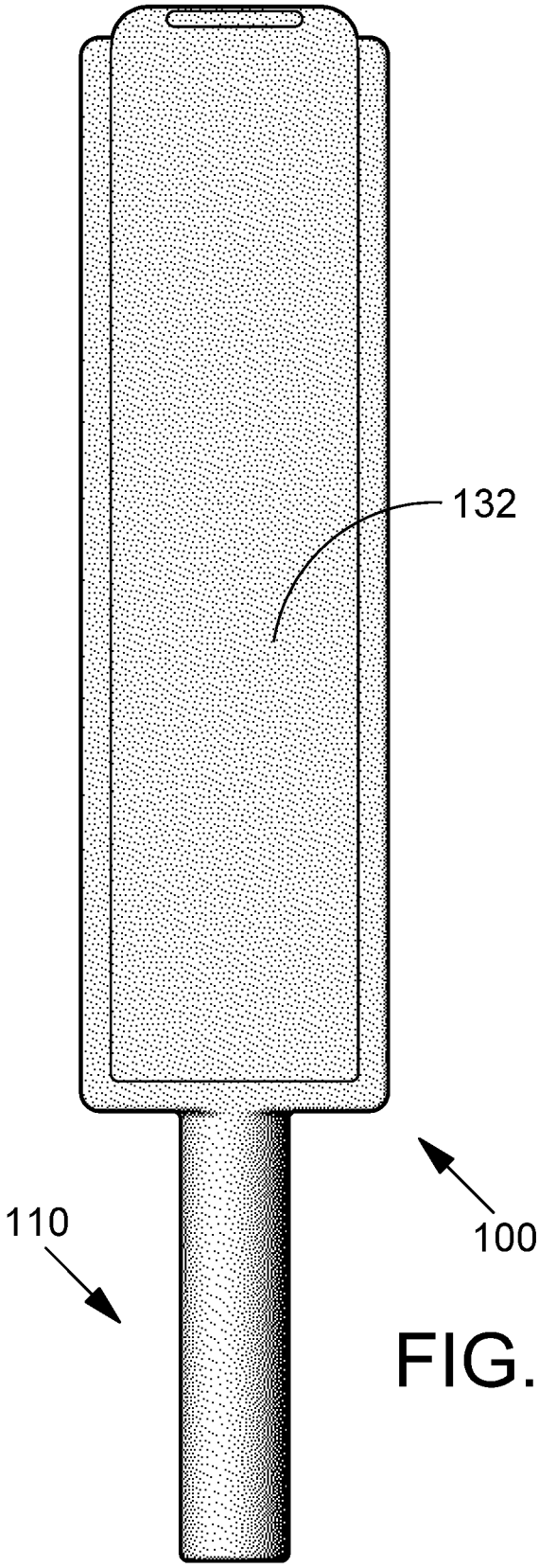
FIG. 9 is a front view of the magazine loader shown in FIG. 8 while the magazine loader is assuming a vertical orientation.
Figure 10:
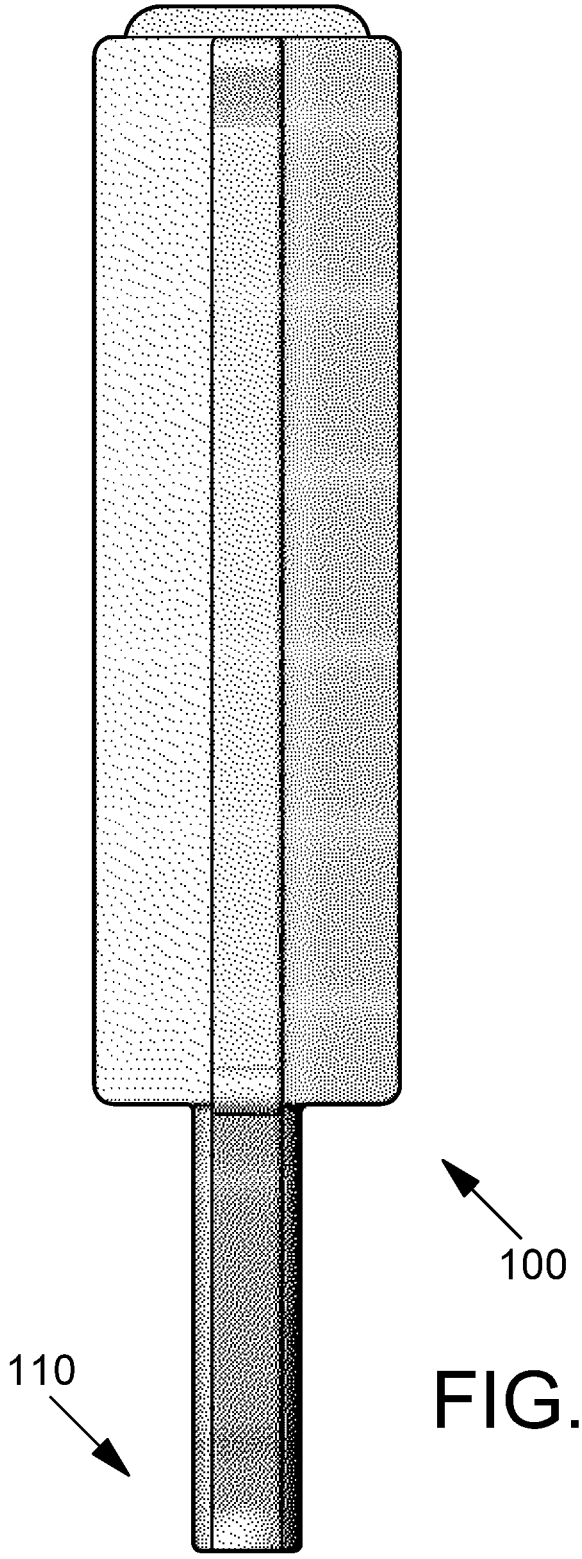
FIG. 10 is a rear view of the magazine loader shown in FIG. 8 while the magazine loader is assuming a vertical orientation.
Figure 11:
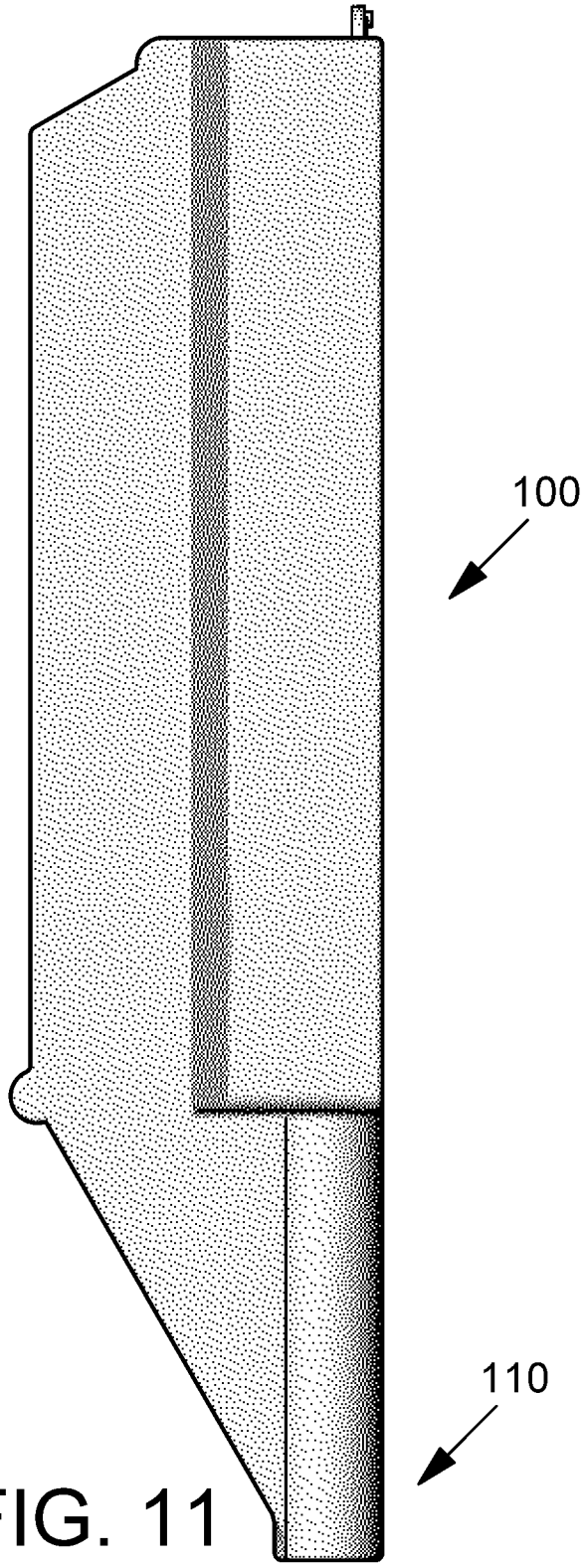
FIG. 11 is a left side view of the magazine loader shown in FIG. 8 while the magazine loader is assuming a vertical orientation.
Figure 12:
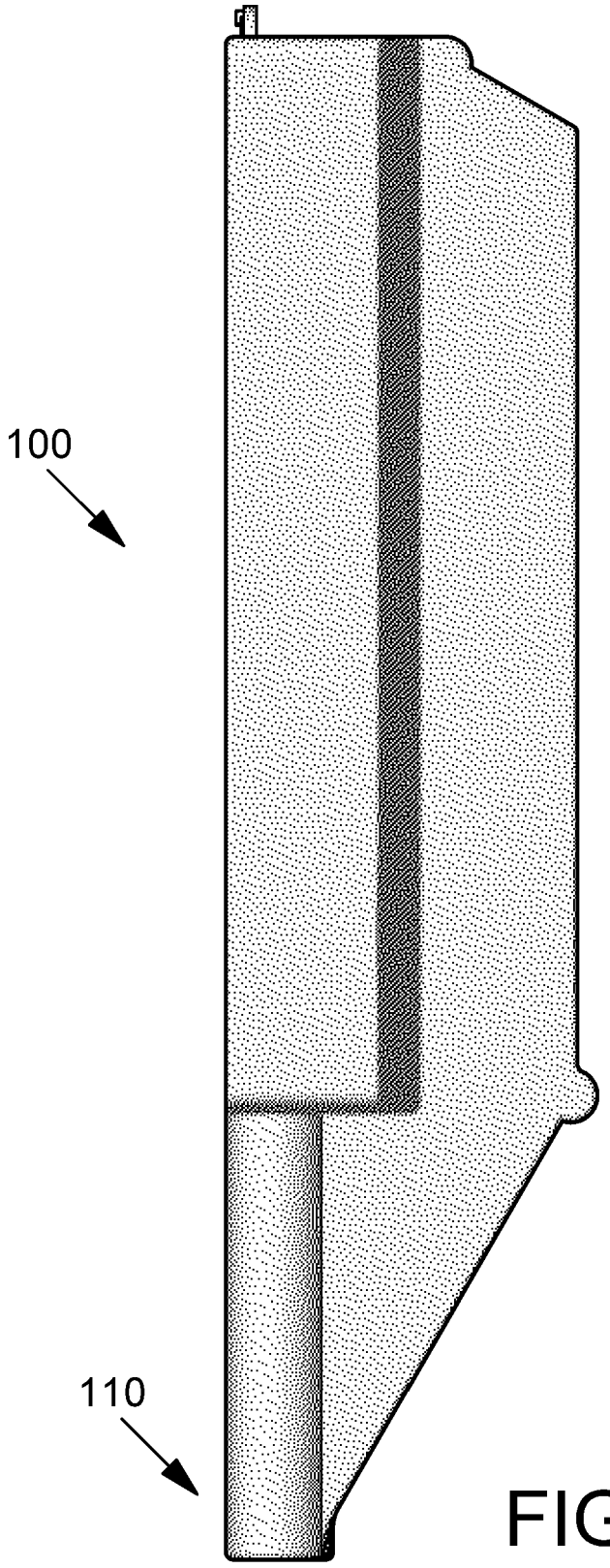
FIG. 12 is a right side view of the magazine loader shown in FIG. 8 while the magazine loader is assuming a vertical orientation.
Figure 13:
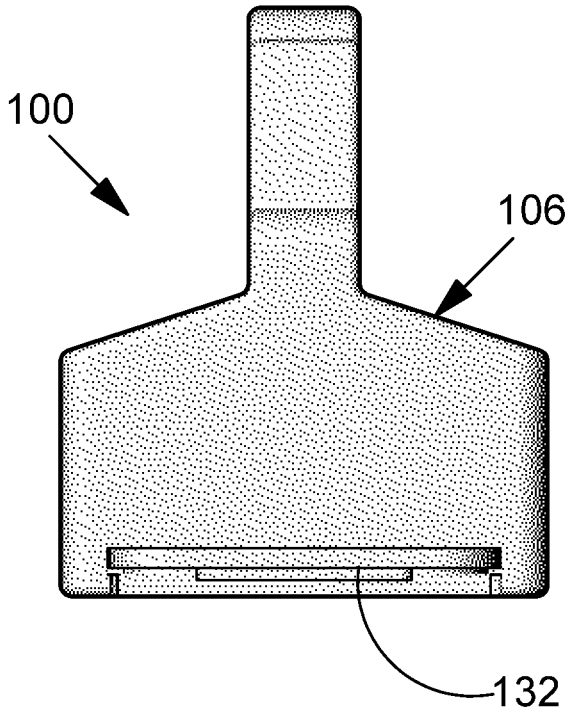
FIG. 13 is a bottom view of the magazine loader shown in FIG. 8 while the magazine loader is assuming a vertical orientation.
Figure 14:
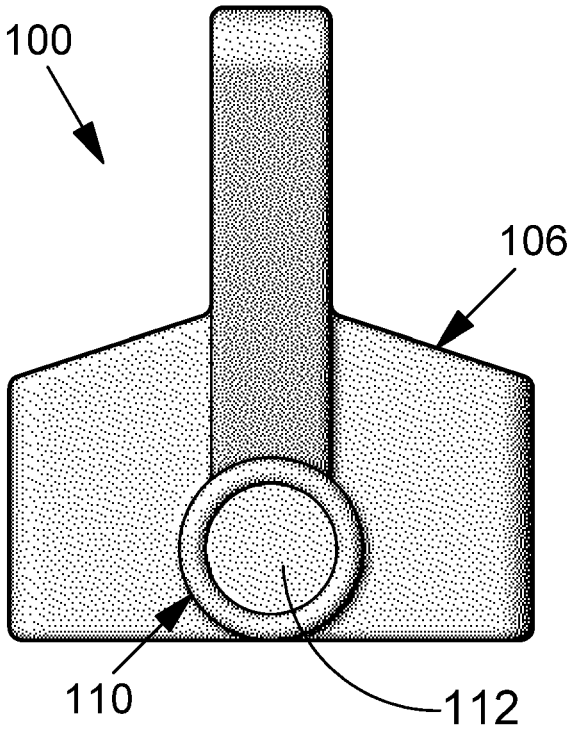
FIG. 14 is a top view of the magazine loader shown in FIG. 8 while the magazine loader is assuming a vertical orientation.
Figure 15:
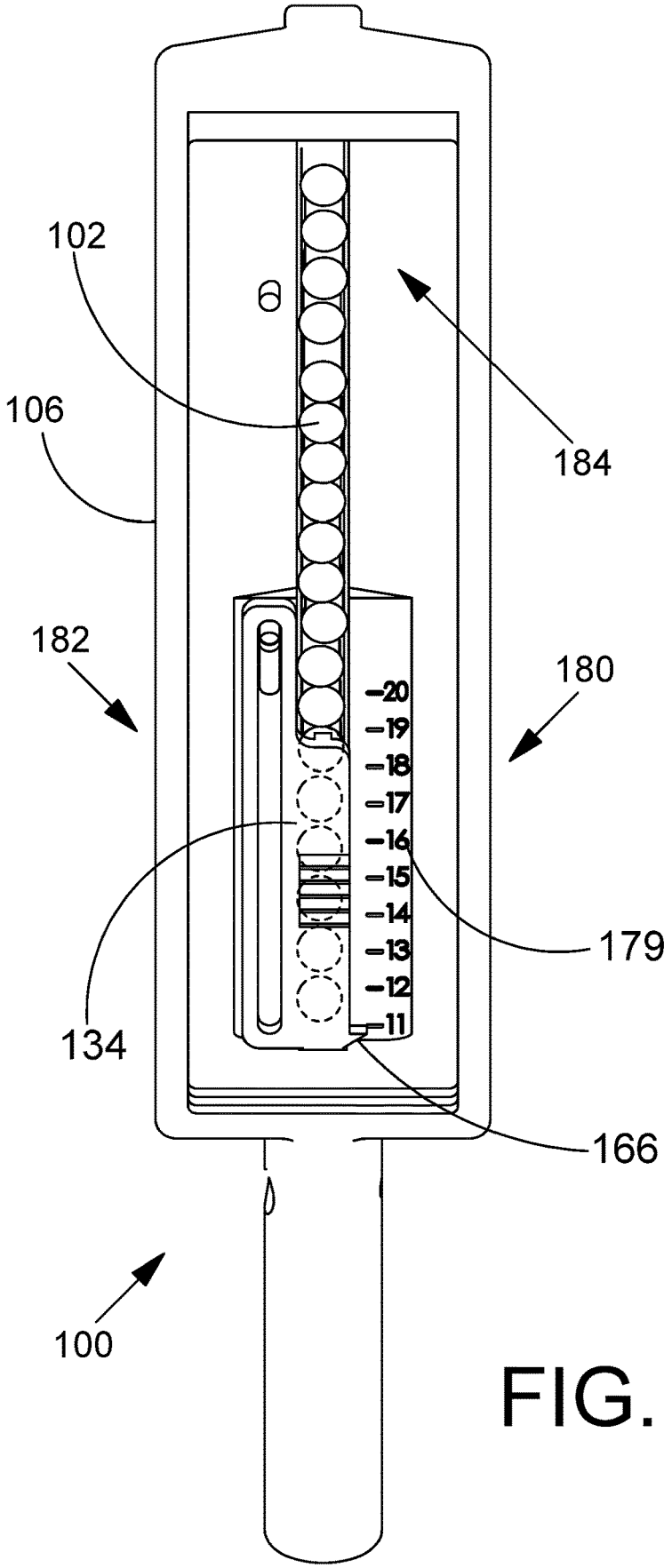
FIG. 15 is a perspective view of a magazine loader in accordance with the detailed description. The closeable cover of the magazine loader has been removed for purposes of illustration in the embodiment of FIG. 15.

Referring to FIGS. 2, 5 and 6, in embodiments, a magazine loader 100 comprises a spring 168 having a first end seated against the moveable gate member 136 and a second end seated against the body 106. The spring 168 may apply a spring bias force to the moveable gate member 136. The spring bias force may bias the moveable gate toward a closed position. In embodiments, the moveable gate member 136 comprises a T-shaped part 172. In embodiments, the T-shaped part 172 has a downward extending leg 174 and two finger engaging tabs 176. In embodiments, a first finger engaging tab 176 extends away from the downward extending leg 174 in a first direction, the second finger engaging tab 176 extends away from the downward extending leg 174 in a second direction, and the second direction being opposite the first direction. In embodiments, the body 106 of the magazine loader 100 comprises a first clamshell portion 178 and a second clamshell portion 178. In embodiments, the first finger engaging tab 176 of the moveable gate member 136 extends through the first clamshell portion 178 and the second finger engaging tab 176 of the moveable gate member 136 extends through the second clamshell portion 178.

Referring to FIGS. 2, 3A, 3B, 6 and 7, in embodiments, the magazine loader 100 comprises an adjustable cartridge quantity selector 134 that is slidingly supported by the body 106 and positioned at the bottom of the hopper cavity 138. In embodiments, the adjustable cartridge quantity selector 134 is positioned to selectively or continuously cover a covered portion 180 of the upper opening of the three-sided channel 140. The length of the covered portion 180 may be varied as the adjustable cartridge quantity selector 134 slides relative to the body 106. In embodiments, the hopper cavity 138 defined by the hopper portion 108 is sized to receive an unordered batch of cartridges 102 and the hopper cavity 138 opens into a three-sided channel 140 located at the bottom thereof. In embodiments the bottom the hopper portion 108 is funnel-like so that upon shaking of the hopper portion 108, a plurality of unordered cartridges 102 enter the three-sided channel 140, the cartridges 102 being guided toward a tip first orientation and aligned side-by-side in a first row in the three-sided channel 140. In embodiments, a first group 182 of the cartridges 102 aligned side-by-side in the first row in the three-sided channel 140 are disposed under the adjustable cartridge quantity selector 134 and a second group 184 of the cartridges 102 aligned side-by-side in the first row in the three-sided channel 140 are not disposed under the adjustable cartridge quantity selector 134. The magazine loader may be tipped toward a vertical orientation, so that the cartridges 102 in the second group 184 not disposed under the adjustable cartridge quantity selector 134 fall out of the three-sided channel 140 and into the hopper cavity 138. The number of cartridges 102 remaining in the three-sided channel 140 may be determined by the position of the adjustable cartridge quantity selector 134 when the magazine loader 100 is tipped toward the vertical orientation. In embodiments, the adjustable cartridge quantity selector 134 comprises a pointer 166 and the body 106 includes quantity indicating indicia 170. In embodiments, the quantity indicating indicia 170 are positioned such that the pointer 166 of the adjustable cartridge quantity selector 134 points to one of the quantity indicating indicia 170 corresponding to the number of cartridges 102 remaining in the three-sided channel 140 after the magazine loader 100 is tipped toward the vertical orientation. Once a selected quantity of cartridges 102 have been placed in the three-sided channel 140, the selected quantity of cartridges 102 can be loaded into a tubular rifle magazine 104.

Referring to FIGS. 2, 5 and 6, in embodiments, a method for loading a batch of rimmed cartridges 102 into a tubular rifle magazine 104 may comprise providing a magazine loader 100 including an adjustable cartridge quantity selector 134 that is slidingly supported by a body 106 and positioned at the bottom of a hopper cavity 138 defined by the body. In embodiments, the adjustable cartridge quantity selector 134 is positioned to selectively or continuously cover a covered portion 180 of an upper opening of a three-sided channel 140 that opens into the hopper cavity 138. The length of the covered portion 180 may be varied as the adjustable cartridge quantity selector 134 slides relative to the body 106. In embodiments the bottom the hopper portion 108 is funnel-like so that upon shaking of the hopper portion 108, a plurality of unordered cartridges 102 enter the three-sided channel 140, the cartridges 102 being guided toward a tip first orientation and aligned side-by-side in a first row in the three-sided channel 140. In embodiments, a first group of the cartridges 102 aligned side-by-side in the first row in the three-sided channel 140 are disposed under the adjustable cartridge quantity selector 134 and a second group of the cartridges 102 aligned side-by-side in the first row in the three-sided channel 140 are not disposed under the adjustable cartridge quantity selector 134. The magazine loader may be tipped away from a vertical orientation, so that the cartridges 102 in the second group not disposed under the adjustable cartridge quantity selector 134 fall out of the three-sided channel 140 and into the hopper cavity 138. The number of cartridges 102 remaining in the three-sided channel 140 may be determined by the position of the adjustable cartridge quantity selector 134 when the magazine loader 100 is tipped away from the vertical orientation. In embodiments, the adjustable cartridge quantity selector 134 comprises a pointer 166 and the body 106 includes quantity indicating indicia 170. In embodiments, the quantity indicating indicia 170 are positioned such that the pointer 166 of the adjustable cartridge quantity selector 134 points to one of the quantity indicating indicia 170 corresponding to the number of cartridges 102 remaining in the three-sided channel 140 after the magazine loader 100 is tipped toward the vertical orientation. Once a selected quantity of cartridges 102 have been placed in the three-sided channel 140, the selected quantity of cartridges 102 can be loaded into a tubular rifle magazine 104.

Referring to FIG. 3B, a number of axes are illustrated using dashed lines. The axes shown in FIG. 3B include a hopper axis 190 extending along the hopper portion 108 of the body 106 and the hopper cavity 138 defined by the hopper portion. The axes shown in FIG. 3B also include an axis 192 extending along the first cartridge orienting passageway 124 defined by the first cartridge orienting portion 116. An axis 194 extending along the second cartridge orienting passageway 126 defined by the second cartridge orienting portion 118 is also shown in FIG. 3B. The axes shown in FIG. 3B also include an axis 196 extending along the third cartridge orienting passageway 128 defined by the third cartridge orienting portion 120. An axis 198 extending along the fourth cartridge orienting passageway 130 defined by the fourth cartridge orienting portion 122 is also shown in FIG. 3B.

Referring to FIGS. 1 and 2, a forward direction Y and a rearward direction −Y are illustrated using arrows labeled "Y" and "−Y," respectively. A starboard direction X and a port direction −X are illustrated using arrows labeled "X" and "−X," respectively. An outboard direction Z and an inboard direction −Z are illustrated using arrows labeled "Z" and "−Z," respectively. The directions illustrated using these arrows are applicable to the apparatus shown and discussed throughout this application. The port direction may also be referred to as the portward direction. In one or more embodiments, the outboard direction is generally opposite the inboard direction. In one or more embodiments, the outboard direction and the inboard direction are both generally orthogonal to an XY plane defined by the forward direction and the starboard direction. In one or more embodiments, the forward direction is generally opposite the rearward direction. In one or more embodiments, the forward direction and the rearward direction are both generally orthogonal to a ZX plane defined by the outboard direction and the starboard direction. In one or more embodiments, the starboard direction is generally opposite the port direction. In one or more embodiments, starboard direction and the port direction are both generally orthogonal to a ZY plane defined by the outboard direction and the forward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "outboardly," "inboardly," "forwardly," "backwardly," "portwardly," and "starboardly," should not be interpreted to limit the scope of the invention recited in the attached claims.

The following United States patents are hereby incorporated by reference herein: U.S. Pat. Nos. 3,628,273, 4,392,321, 4,736,667, and 5,301,449. The documents identified by the following United States publication numbers are hereby incorporated by reference herein: US2003/0046854 and US2014/0033592.

The above references in all sections of this application are herein incorporated by references in their entirety for all purposes. Components illustrated in such patents may be utilized with embodiments herein. Incorporation by reference is discussed, for example, in MPEP section 2163.07(B).

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A magazine loader for loading rimmed cartridges into a tubular rifle magazine, the magazine loader comprising:

a hopper including a hopper cavity for receiving the rimmed cartridges;

a magazine receiving portion coupled to the hopper and including an aperture for aligning with the tubular rifle magazine;

a channel extending between the hopper cavity and the aperture, and including first and second portions, wherein the first portion opens into the hopper cavity and is configured to receive and orient the rimmed cartridges in a first orientation with respect to the channel, the second portion extends from the first portion and is configured to receive the oriented rimmed cartridges from the first portion and orient the rimmed cartridges in a second orientation with respect to the channel and guide the rimmed cartridges towards the aperture; and a gate member disposed between the first and second portions and actuatable between a closed position and a magazine loading position, wherein actuation of the gate to the magazine loading position allows the oriented rimmed cartridges to flow into the second portion and towards the aperture.

2. The magazine loader of claim 1, further comprising a closeable hopper cover disposed at an end of the hopper.

3. The magazine loader of claim 1, wherein the hopper includes a pair of sloped walls that converge towards one another as the sloped walls extend towards the channel.

4. The magazine loader of claim 1, further comprising an adjustable cartridge quantity selector disposed at a distal end of the hopper.

5. The magazine loader of claim 4, wherein the adjustable cartridge quantity selector covers a portion of an opening of the channel, and a length of the portion covered varies as the adjustable cartridge quantity selector slides relative to the channel.

6. The magazine loader of claim 5, wherein a number of the rimmed cartridges disposed in the channel is selectable by sliding the adjustable cartridge quantity selector.

7. The magazine loader of claim 1, wherein the gate member includes a T-shaped part having a leg and first and second finger engaging tabs, the first finger engaging tab extending away from the leg in a first direction and the second finger engaging tab extending away from the leg in a second direction opposite the first direction.

8. The magazine loader of claim 1, further comprising a spring having a first end seated against the gate member and applying a spring bias force to the gate member to bias the gate member towards the closed position.

9. The magazine loader of claim 1, wherein the first portion includes a first cartridge orienting passageway configured to orient the rimmed cartridges into a tip first orientation and into a side-by-side row.

10. The magazine loader of claim 9, wherein the second portion includes a second cartridge orienting passageway configured to receive the oriented rimmed cartridges from the first cartridge orienting passageway and further orient and guide the rimmed cartridges towards the aperture.

11. A magazine loader for loading rimmed cartridges into a tubular rifle magazine, the magazine loader comprising:

a hopper including a hopper cavity for receiving the rimmed cartridges;

a magazine receiving portion coupled to the hopper and including an aperture for aligning with the tubular rifle magazine; and a channel extending between the hopper and the aperture, and including first, second, and third cartridge orienting passageways, wherein:

the hopper cavity opens into the first cartridge orienting passageway, and the first cartridge orienting passageway is configured to orient the rimmed cartridges into a tip first orientation and into a side-by-side row;

the second cartridge orienting passageway extends from the first cartridge orienting passageway, and the second cartridge orienting passageway is configured to receive the rimmed cartridges from the first cartridge orienting passageway and orient the rimmed cartridges into a side-by-side row inclined with respect to an axis of second cartridge orienting passageway; and the third cartridge orienting passageway extends from the second cartridge orienting passageway, and the third cartridge orienting passageway is configured to receive the rimmed cartridges from the second cartridge orienting passageway and orient the rimmed cartridges into a rimmed end to tip row and guide the rimmed cartridges towards the aperture.

12. The magazine loader of claim 11, further comprising a closeable hopper cover disposed at an end of the hopper.

13. The magazine loader of claim 11, wherein the hopper includes a pair of sloped walls that converge towards one another as the sloped walls extend towards the channel.

14. The magazine loader of claim 11, further comprising an adjustable cartridge quantity selector disposed at a distal end of the hopper.

15. The magazine loader of claim 14, wherein the adjustable cartridge quantity selector covers a portion of an opening of the channel, and a length of the portion covered varies as the adjustable cartridge quantity selector slides relative to the channel.

16. The magazine loader of claim 15, wherein a number of the rimmed cartridges disposed in the channel is selectable by sliding the adjustable cartridge quantity selector.

17. The magazine loader of claim 16, wherein the adjustable cartridge quantity selector includes a pointer and the magazine loader further includes quantity indicating indicia, wherein the pointer slides with the adjustable cartridge quantity selector to point to one of the quantity indicating indicia to select the number of the rimmed cartridges.

18. The magazine loader of claim 11, further comprising a gate member disposed between the second and third cartridge orienting passageways, and actuatable between a closed position and a magazine loading position.

19. The magazine loader of claim 18, wherein the gate member includes a T-shaped part having a leg and first and second finger engaging tabs, the first finger engaging tab extending away from the leg in a first direction and the second finger engaging tab extending away from the leg in a second direction opposite the first direction.

20. The magazine loader of claim 18, further comprising a spring having a first end seated against the gate member and applying a spring bias force to the gate member to bias the gate member towards the closed position.

* * * * *